US010882079B2

(12) United States Patent
Sakai

(10) Patent No.: US 10,882,079 B2
(45) Date of Patent: Jan. 5, 2021

(54) CLEANING DEVICE AND ELECTROSPINNING APPARATUS

(71) Applicant: Kabushiki Kaisha Toshiba, Minato-ku (JP)

(72) Inventor: Satomi Sakai, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 326 days.

(21) Appl. No.: 15/886,236

(22) Filed: Feb. 1, 2018

(65) Prior Publication Data

US 2018/0250718 A1 Sep. 6, 2018

Related U.S. Application Data

(63) Continuation of application No. PCT/JP2017/027685, filed on Jul. 31, 2017.

(30) Foreign Application Priority Data

Mar. 3, 2017 (JP) ..... 2017-040440

(51) Int. Cl.
*D01D 4/04* (2006.01)
*D01D 5/00* (2006.01)
(Continued)

(52) U.S. Cl.
CPC ..... *B08B 3/022* (2013.01); *B05B 5/03* (2013.01); *B05B 5/053* (2013.01); *B05B 5/084* (2013.01);
(Continued)

(58) Field of Classification Search
CPC ..... B08B 1/002; B08B 1/005; B08B 1/006; B08B 1/008; B08B 1/04; B08B 3/04;
(Continued)

(56) References Cited

U.S. PATENT DOCUMENTS 3,384,690 A 5/1968 Lockhart
4,124,666 A 11/1978 Wilhelm et al.
(Continued)

FOREIGN PATENT DOCUMENTS

CN 205032411 U 2/2016
JP 53-006613 1/1978
(Continued)

OTHER PUBLICATIONS

International Search Report dated Sep. 5, 2017 in PCT/JP2017/027685 filed Jul. 31, 2017 (with English Translation of Categories of Cited Documents).
(Continued)

*Primary Examiner* — Xiao S Zhao
*Assistant Examiner* — Joseph S Leyson
(74) *Attorney, Agent, or Firm* — Oblon, McClelland, Maier & Neustadt, L.L.P.

(57) ABSTRACT

According to one embodiment, a cleaning device cleans a nozzle provided on a nozzle head of an electrospinning apparatus. The device includes a storage part and a cleaning part. The storage part is box-shaped, and one surface of the storage part is open. The cleaning part is provided inside the storage part, is flexible, and is capable of holding a solution.

5 Claims, 7 Drawing Sheets

(51) Int. Cl.

| | |
|---|---|
| ***B08B 1/04*** | (2006.01) |
| ***B08B 3/08*** | (2006.01) |
| ***B08B 3/02*** | (2006.01) |
| ***B05B 5/053*** | (2006.01) |
| ***B05B 5/16*** | (2006.01) |
| ***B05B 5/03*** | (2006.01) |
| ***B05B 9/04*** | (2006.01) |
| ***B05B 5/08*** | (2006.01) |
| ***B05B 15/55*** | (2018.01) |
| ***B08B 1/00*** | (2006.01) |
| *B05B 13/02* | (2006.01) |

(52) U.S. Cl.
CPC ..... *B05B 5/1608* (2013.01); *B05B 9/04* (2013.01); *B05B 15/55* (2018.02); *B08B 1/002* (2013.01); *B08B 1/008* (2013.01); *B08B 1/04* (2013.01); *B08B 3/08* (2013.01); *D01D 4/04* (2013.01); *D01D 5/0061* (2013.01); *D01D 5/0069* (2013.01); *B05B 13/0221* (2013.01)

(58) Field of Classification Search
CPC .. B08B 3/041; B08B 3/08; B05B 5/03; B05B 5/053; B05B 5/084; B05B 5/1608; B05B 13/0221; B05B 15/55; D01D 4/04; D01D 5/0061; D01D 5/0069
See application file for complete search history.

(56) References Cited

U.S. PATENT DOCUMENTS

| | | | | |
|---|---|---|---|---|
| 4,872,235 | A * | 10/1989 | Nielsen | A45D 24/44 15/104.92 |
| 2003/0127046 | A1* | 7/2003 | Zehner | B08B 1/04 118/302 |
| 2015/0335143 | A1* | 11/2015 | Edmond | B08B 9/027 15/88 |

FOREIGN PATENT DOCUMENTS

| | | |
|---|---|---|
| JP | 2003-275637 | 9/2003 |
| JP | 2005-074671 | 3/2005 |
| JP | 2007-303015 | 11/2007 |
| JP | 2008-202169 | 9/2008 |
| JP | 2010-236133 | 10/2010 |
| JP | 2013-155457 | 8/2013 |

OTHER PUBLICATIONS

Written Opinion dated Sep. 5, 2017 in PCT/JP2017/027685 filed Jul. 31, 2017.

* cited by examiner

CLEANING DEVICE AND ELECTROSPINNING APPARATUS

CROSS-REFERENCE TO RELATED APPLICATIONS

This is a continuation application of International Application PCT/JP2017/027685, filed on Jul. 31, 2017. This application also claims priority to Japanese Patent Application No. 2017-040440, filed on Mar. 3, 2017. The entire contents of each are incorporated herein by reference.

FIELD

Embodiments described herein relate generally to a cleaning device and an electrospinning apparatus.

BACKGROUND

There has been an electrospinning apparatus which deposits fine fiber on a surface of a member by an electrospinning method (it is called an electrospinning method, a charge induced spinning method or the like). The electrospinning apparatus is provided with a nozzle discharging a source material liquid.

Here, when the electrospinning apparatus is stopped, supply of the source material liquid to the nozzle head and application of a voltage to the nozzle head are stopped, and thus discharge of the source material liquid from the nozzle is stopped. However, a residual pressure exists inside a pipe for sending liquid connected to the nozzle head and inside the nozzle head. Therefore, even if the electrospinning apparatus is stopped, the source material liquid may be leaked out from the nozzle. If the source material liquid is leaked out from the nozzle, there is a fear that a droplet of the source material liquid adheres to a tip of the nozzle and the source material liquid dries to adhere to the tip of the nozzle as a polymer substance. If the droplet of the source material liquid with increasing viscosity after the drying and the polymer substance adhere to the tip of the nozzle, nozzle clogging may occur.

Therefore, the tip of the nozzle is cleaned as necessary. However, the number of the nozzle tends to increase for improvement of productivity, and thus it becomes difficult to clean the nozzle efficiently.

Then, it has been desired to develop a technique capable of improving cleaning performance.

DETAILED DESCRIPTION

Figure 1:
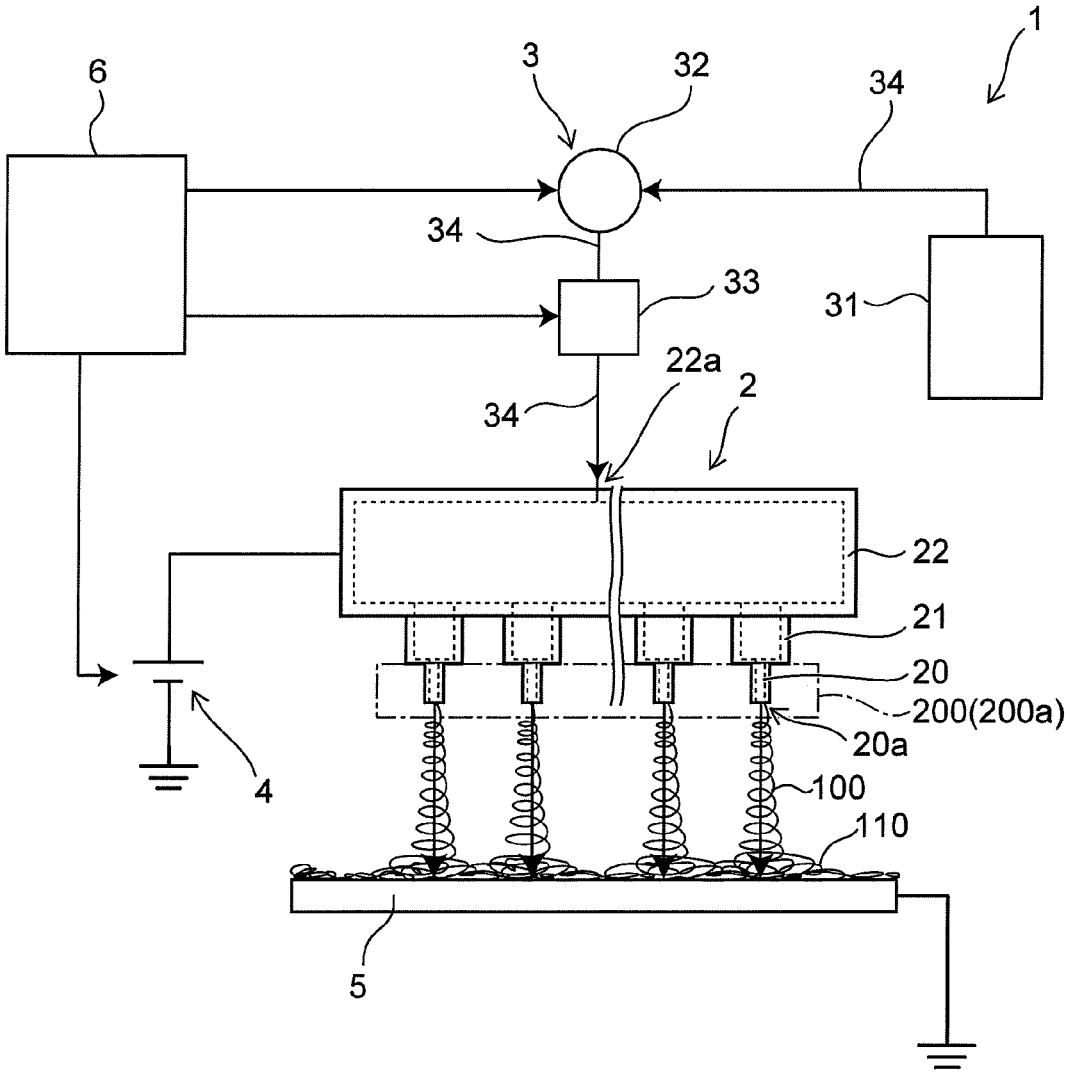
FIG. 1 is a schematic view illustrating a cleaning device and an electrospinning apparatus according to the embodiment.

According to one embodiment, a cleaning device cleans a nozzle provided on a nozzle head of an electrospinning apparatus. The device includes a storage part and a cleaning part. The storage part is box-shaped, and one surface of the storage part is open. The cleaning part is provided inside the storage part, is flexible, and is capable of holding a solution.

Various embodiments will be described hereinafter with reference to the accompanying drawings. In the drawings, similar components are marked with like reference numerals and the detailed description is omitted as appropriate.

In the following, the electrospinning apparatus including a so called needle type nozzle head is illustrated as an example.

However, the nozzle head is not limited to the needle type nozzle head.

For example, the nozzle head may be a so called blade type nozzle head or the like. Since the blade type nozzle head is able to increase a mechanical strength, the nozzle can be suppressed from being damaged on cleaning or the like. The cleaning of the nozzle becomes easy. The figure of the blade type nozzle head is not particularly limited, and for example, may be rectangular parallelepiped or arc-shaped.

As shown in FIG. 1, an electrospinning apparatus 1 according to the embodiment includes a nozzle head 2, a source material liquid supply part 3, a power supply 4, a collection part 5, and a controller 6.

The nozzle head 2 includes a nozzle 20, a connection part 21, and a main body part 22.

One or more nozzles can be provided. For improvement productivity, it is favorable to provide multiple nozzles 20. When providing the multiple nozzles 20, the multiple nozzles 20 can be provided to be arranged with a prescribed spacing. The number and the arrangement figure of the nozzles 20 are not limited to the illustration, but can be changed appropriately depending on a size of the collection part 5 or the like. For example, the multiple nozzles 20 can be provided to be arranged in a line, provided to be arranged on a circumference or a concentric circle, and provided to be arranged in a matrix.

The nozzle 20 is acicular. The acicular nozzle 20 would be easy to generate an electric field concentration in the vicinity of a discharge port 20*a* of the nozzle 20, and thus the electric field strength formed between the nozzle 20 and the collection part 5 is increased. A hole for discharging the source material liquid is provided inside the nozzle 20. The hole for discharging the source material liquid pierces between an end portion of the connection part side of the nozzle 20 and an end portion (tip) on the source material liquid discharge side of the nozzle 20. An opening on the source material liquid discharge side of the hole provided inside the nozzle 20 serves as the discharge port 20*a*. An outer dimension in a direction orthogonal to an extending direction of the nozzle 20 (hereinafter, simply referred to as an outer dimension of the nozzle 20) can be, for example, approximately 1 mm. A cross section dimension in a direction orthogonal to an extending direction of the nozzle 20 (hereinafter, simply referred to as a cross section dimension of the discharge port 20*a*) is not particularly limited. The cross section dimension of the discharge port 20*a* can be appropriately changed depending on the cross section dimension of a fiber 100 to be formed in a direction being orthogonal to an extending direction of the fiber 100. The cross section dimension of the discharge port 20*a* can be, for example, 200 μm or more. The nozzle 20 can be formed, for example, of stainless steel or the like.

The connection part 21 is provided between the nozzle 20 and the main body part 22. The connection part 21 is not always necessary, and the nozzle 20 may be provided directly on the main body part 22. A hole for supplying the source material liquid from the main body part 22 to the nozzle 20 is provided inside the connection part 21. The hole provided inside the connection part 21 is linked to the hole provided inside the nozzle 20 and a space provided inside the main body part 22. The connection part 21 can be formed, for example, of stainless steel or the like.

The main body part 22 is plate-shaped. The space storing the source material liquid is provided inside the main body part 22. The multiple nozzles 20 are provided on one end of the main body part 22 via the connection part 21. A supply port 22*a* is provided on the main body part 22. The source material liquid supplied from the source material liquid supply part 3 is introduced inside the main body part 22 via the supply port 22*a*.

The source material liquid supply part 3 includes a storage part 31, a supply part 32, a source material liquid controller 33, and a pipe 34.

The storage part 31 stores the source material liquid. The storage part 31 is formed of a material having resistance to the source material liquid. The storage part 31 can be formed, for example, of stainless steel or the like.

The source material liquid is formed by dissolving the polymer substance into a solvent.

The polymer substance is not particularly limited, and can be appropriately changed depending on quality of material of the fiber 100 to be formed. The polymer substance can be, for example, polypropylene, polyethylene, polystyrene, polyethylene terephthalate, polyvinyl chloride, polycarbonate, nylon, aramid or the like.

The solvent may be any solvent as long as it can dissolve the polymer substance. The solvent can be appropriately changed depending on the polymer substance to be dissolved. The solvent can be, for example, methanol, ethanol, isopropyl alcohol, acetone, benzene, toluene or the like.

The polymer substance and the solvent are not limited to the illustration.

The source material liquid is made to stay in the vicinity of the discharge port 22*a* by a surface tension. Viscosity of the source material liquid can be appropriately changed depending on the dimension or the like of the discharge port 20*a*. The viscosity of the source material liquid can be determined by performing an experiment or a simulation. The viscosity of the source material liquid can be controlled by a mixing ratio of the solvent and the polymer substance.

The supply part 32 supplies the source material liquid stored in the storage part 31 to the main body part 22. The supply part 32 can be, for example, a pump having resistance to the source material liquid. The supply part 32 can, for example, supply a gas to the storage part 31 and also can pressure feed the source material liquid stored in the storage part 31.

The source material liquid controller 33 controls a flow rate and a pressure or the like of the source material liquid supplied to the main body part 22, and prevents the source material liquid in the main body part 22 from being pushed out from the discharge port 20*a* when new source material liquid is supplied inside the main body part 22. The source material liquid controller 33 can be, for example, a flow rate control valve or a pressure control valve or the like. A control amount of the source material liquid controller 33 can be appropriately changed by the dimension of the discharge port 20*a* and the viscosity of the source material liquid or the like. The control amount of the source material liquid controller 33 can be determined by performing an experiment or a simulation. The source material liquid controller 33 can switch start of the supply of the source material liquid and stop of the supply.

The pipe 34 is provided between the storage part 31 and the supply part 32, between the supply part 32 and the source material liquid controller 33, and between the source material liquid controller 33 and the main body part 22. The pipe 34 forms a flow channel of the source material liquid. The pipe 34 is formed of the material having resistance to the source material liquid.

The power supply 4 applies a voltage to the nozzle 20 via the main body part 22 and the connection part 21. Terminals not shown and electrically connected to the multiple nozzles 20 may be provided. In this case, the power supply 4 applies the voltage to the nozzles 20 via the terminals not shown. That is, it is sufficient that the voltage can be applied to the multiple nozzles 20 from the power supply 4.

A polarity of the voltage applied to the nozzle 20 can be set to be either plus or minus. The power supply 4 illustrated in FIG. 1 applies the plus voltage to the nozzle 20. The voltage applied to the nozzle 20 can be appropriately changed depending on a type of polymer substance included in the source material liquid, and a distance between the nozzle 20 and the collection part 5 or the like. For example, the power supply 4 applies the voltage to the nozzle 20 so that a potential difference between the nozzle 20 and the collection part 5 is not less than 10 kV. The power supply 4 can be, for example, a DC high voltage power supply. The power supply 4 outputs, for example, a DC voltage of not less than 10 kV and not more than 100 kV.

The collection part 5 is provided on the source material liquid discharge side of the nozzle 20. The collection part 5 can be grounded, for example. A voltage of opposite polarity to the voltage applied to the nozzle 20 may be applied to the collection part 5. The collection part 5 can be formed of a conductive material. It is favorable that the material of the collection part 5 has conductivity and resistance to the source material liquid. The material of the collection part 5 can be, for example, stainless steel or the like.

The collection part 5 can be, for example, plate-shaped or sheet-shaped. In the case of the sheet-shaped collection part 5, the fiber 100 can be deposited on the collection part 5 wound around a roll or the like.

The collection part 5 may move. For example, a pair of rotation drums and a drive part for rotating the rotation drums may be provided, and the collection part 5 may be moved between the pair of rotation rums like a belt conveyor. In this way, since it is possible to move the region where the fiber 100 is deposited, continuous deposition work becomes possible. Therefore, the production efficiency of a deposition body 110 including the fiber 100 can be improved.

The collection part 5 may be a base of the product.

In general, the deposition body 110 formed on the collection part 5 is removed from the collection part 5. In this case, for example, the deposition body 110 is used for nonwoven fabric and filter or the like. However, there is a case where the deposition body 110 is formed directly on the surface of the base of the product. In such a case, it is sufficient that the conductive base is grounded, or a voltage with an opposite polarity to the voltage applied to the nozzle 20 is applied to the conductive base.

The controller 6 controls the action of the supply part 32, the source material liquid controller 33, and the power supply 4. The controller 6 can be, for example, a computer including CPU (Central Processing Unit) and a memory or the like.

Next, the operation of the electrospinning apparatus 1 will be described.

The source material liquid stays in the vicinity of the discharge port 20*a* of the nozzle 20 due to the surface tension.

The power supply 4 applies the voltage to the nozzle 20. Then, the source material liquid in the vicinity of the discharge port 20*a* is charged to a prescribed polarity. In the case illustrated in FIG. 1, the source material liquid in the vicinity of the discharge port 20*a* is charged to a positive polarity.

Since the collection part 5 is grounded, an electric field is formed between the nozzle 20 and the collection part 5. If an electrostatic force operating along an electric line of force becomes larger than the surface tension, the source material liquid in the vicinity of the discharge port 20*a* is drawn out toward the collection part 5 by the electrostatic force. The drawn out source material liquid is stretched and the solvent included in the source material liquid is volatilized, and thus the fiber 100 is formed. The formed fiber 100 is deposited on the collection part 5, and thus the deposition body 110 is formed.

Here, in the case where the electrospinning apparatus 1 is abnormally stopped during production, or the electrospinning apparatus 1 is stopped at completion of production, the controller 6 stops the supply of the source material liquid to the nozzle head 2 and the application of the voltage to the nozzle head 2. Therefore, the source material liquid in the vicinity of the discharge port 20*a* of the nozzle 20 is stopped to be drawn out. However, a supply pressure is kept to be applied to the source material liquid inside the pipe 34 between the source material liquid controller 33 and the main body part 22, and the source material liquid inside the main body part 22. That is, there exists a residual pressure inside the pipe 34 connected to the main body part 22 and inside the main body part 22. Therefore, even if the supply of the source material liquid is stopped by the source material liquid controller 33, the source material liquid in the vicinity of the discharge port 20*a* of the nozzle 20 may be leaked out. If the source material liquid is leaked out from the nozzle 20, there is a fear that the droplet of the source material liquid adheres to the tip of the nozzle 20, and the polymer substance adheres to the tip of the nozzle 20 with drying of the source material liquid. If the droplet of the source material liquid with increasing viscosity after the drying and the polymer substance adhere to the tip of the nozzle 20, there is a fear that discharge of the source material liquid from the discharge port 20*a* is inhibited and the fiber 100 is not formed adequately. There is also a fear that the discharge port 20*a* is closed by the droplet of the source material liquid with increasing viscosity and the polymer substance, and nozzle 20 clogging may occur.

Therefore, the tip of the nozzle 20 is cleaned as necessary or regularly. In general, the source material liquid adhered to the tip of the nozzle 20 is intentionally wiped off with cloth or the like before solidification of the source material liquid.

However, since the solvent included in the source material liquid is highly volatile, wiping off before solidification of the source material liquid needs frequent cleaning.

Therefore, time for stopping the electrospinning apparatus 1 becomes long because of the cleaning, which causes a decrease in productivity.

Since the acicular nozzle 20 has low strength, if the adhered source material liquid is intended to be wiped off in one time, the nozzle 20 may be bent or may be damaged. Therefore, it is necessary to clean the multiple nozzles 20 one at a time. Recently, since the number of nozzles 20 tends to increase for improving the productivity, time necessary for the cleaning becomes further long.

Then, when the cleaning of the nozzle 20 is needed, the nozzle 20 is cleaned by using a cleaning device 200 according to the embodiment.

Figure 2A:
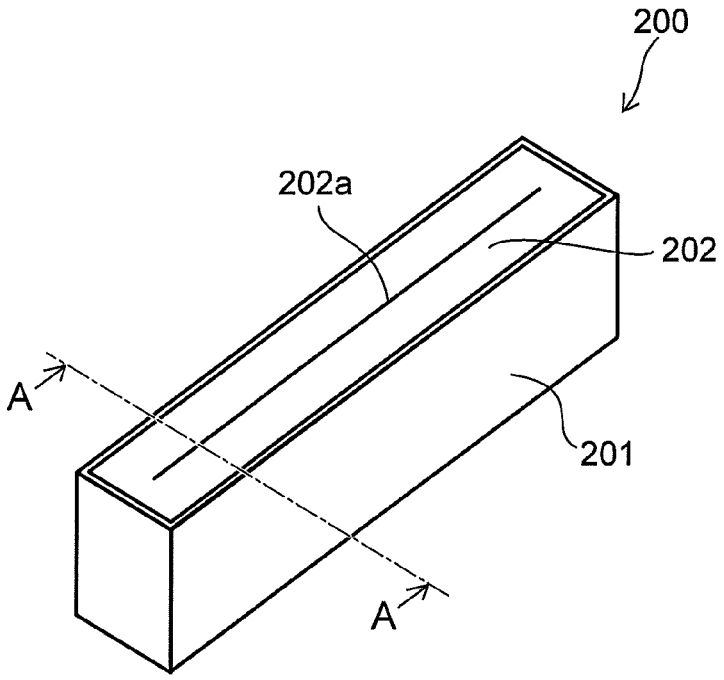
FIGS. 2A and 2B are schematic perspective views illustrating the cleaning device.
Figure 2B:
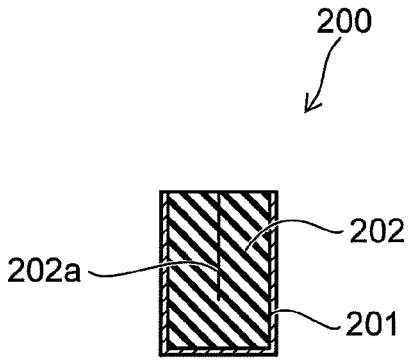

As shown in FIG. 2A, 2B, the cleaning device 200 includes a storage part 201 and a cleaning part 202.

The storage part 201 is box-shaped, and one surface is opened. The cleaning part 202 is provided inside the storage part 201. Therefore, the cleaning part 202 is exposed to one surface side of the storage part 201. An exposed surface of the cleaning part 202 (a surface opposite to the bottom surface of the storage part 201) can be provided also at a position of an opening of the storage part 201, can be provided also at a slightly outer position from the position of the opening of the storage part 201, and can be provided also at a slightly inner position from the position of the opening of the storage part 201.

The solution is supplied inside the storage part 201. The supplied solution is held in the cleaning part 202. The solution is not particularly limited as long as it can dissolve the polymer substance included in the source material liquid. The solution can be, for example, the same liquid as the solvent included in the source material liquid described above.

The storage part 201 has function of holding the cleaning part 202, function of protecting the cleaning part 202, function of holding the solution, and function of suppressing evaporation of the solution.

For example, by providing the cleaning part 202 inside the storage part 201, the storage part 201 holds the cleaning part 202, and the storage part 201 protect the cleaning part 202 from an external force or the like. Since the storage part 201 is box-shaped, the solution supplied inside the storage part 201 can be held. Since the opening of the storage part 201 is only on the one surface, the solution held in the cleaning part 202 can be suppressed from being evaporated.

The material of the storage part 201 is not limited particularly as long as it has resistance to the solution and a certain degree of rigidity. The storage part 201 can be formed, for example, of a metal such as stainless steel or a resin such as nylon and polyimide.

The cleaning part 202 is flexible and holds the solution. The cleaning part 202 can be formed, for example, of a polymer amorphous body. As the polymer amorphous body, for example, polymer foam such as resin foam (plastic foam) can be illustrated. In this case, considering holding the solution, it is favorable that the cleaning part 202 has a continuous bubble structure. The cleaning part 202 can be formed, for example, of a sponge based on melamine foam (foamed melamine) and urethane foam (foamed poly urethane). The solution is held inside the hole and the gap inside the cleaning part 202.

Holding the cleaning part 202 can be made also by a bonding material such as an adhesive, and can be made also by an elastic force of the cleaning part 202.

As described later, since the nozzle 20 is inserted into the cleaning part 202, the cleaning part 202 is damaged although it is a little by little. The source material liquid and the polymer substance adhered to the tip of the nozzle 20 result in remaining inside the cleaning part 202. Therefore, the cleaning part 202 can be an expendable. In this case, if the cleaning part 202 is held inside the storage part 201 by using the elastic force of the cleaning part 202, exchange can be easy.

The cleaning part 202 may has a notch 202*a* into which the nozzle 20 is inserted. A finer hole than the nozzle 20 can be provided in place of the notch 202*a* as well. If the notch 202*a* and the hole are provided, the damage of the cleaning part 202 can be suppressed, and thus the exchange frequency of the cleaning part 202 can be reduced. If the finer hole than the notch 202*a* and the nozzle 20 are provided, the cleaning part 202 can be made close contact with the nozzle 20, and thus it is possible to wipe off or dissolve the source material liquid and the polymer substance adhered to the tip of the nozzle 20. If considering alignment accuracy when inserting the nozzle 20 into the hole, it is favorable to provide the notch 202*a*. If the notch 202*a* is provided, the cleaning of the blade type nozzle head can be made easy. If the cleaning of the blade type nozzle head is performed, a groove can be provided in place of the notch 202*a*. In this case, a width of the groove should be more shortened than a thickness of the blade type nozzle head. Since a known art can be applied to the blade type nozzle head, the detailed description of the blade type nozzle head is omitted.

When the cleaning of the nozzle head is performed, at first, the tip of the nozzle 20 is inserted into the cleaning part 202 from the opening side of the cleaning part 202. At this time, it is favorable that an angle between the exposed surface of the cleaning part 202 and the extending direction of the nozzle 20 makes approximately 90°. In this case, it can be possible that the cleaning device 200 is caused to move toward the nozzle 20 as well and the nozzle 20 is caused to move toward the cleaning device 200 as well. Since the tip of the nozzle 20 is inserted into the cleaning part 202, the cleaning part 202 makes close contact with the droplet of the source material liquid and the polymer substance adhered to the tip of the nozzle 20, and the solution held in the cleaning part 202 makes contact with the droplet of the source material liquid and the polymer substance. The droplet of the source material liquid and the polymer substance are dissolved by the solution.

Next, the tip of the nozzle 20 is extracted from the inside the cleaning part 202. Then, the cleaning part 202 wipes off the droplet of the source material liquid and the polymer substance. At this time, since the droplet of the source material liquid and the polymer substance are dissolved by the solution, the droplet of the source material liquid and the polymer substance are easily removed.

In the cleaning device 200 according to the embodiment, cleaning performance can be improved.

There is a case where a prescribed time is necessary for dissolving the polymer substance. In such a case, the tip of the nozzle 20 should be extracted from the inside of the cleaning part 202 after the prescribed time passes.

In the case where removal of the droplet of the source material liquid and the polymer substance is insufficient, insertion and extraction of the tip of the nozzle 20 can be performed repeatedly. A relative movement speed of the cleaning device 200 (speed of the insertion and the extraction of the tip of the nozzle 20) can be, for example, approximately 10 cm/second.

Completion of the cleaning of the nozzle 20 can be, for example, visually checked by an operator as well, and can be checked by using an image processing device as well.

After the cleaning of the nozzle 20 is completed, the electrospinning apparatus 1 is re-operated.

In the case where time for re-operating the electrospinning apparatus 1 becomes long due to interruption or finish of production, the tip of the nozzle 20 after the cleaning can be also inserted into the cleaning part 202. In this case, it is also possible to hold the cleaning device 200 by the adhesion force between the nozzle 20 and the cleaning part 202, and is also possible to hold the cleaning device 200 on the component of the electrospinning apparatus 1 by a magnet or a screw. The solution is held inside the cleaning part 202, and the solution dissolves the polymer substance included in the solution, and thus it is possible to suppress the solidification of the source material liquid inside the nozzle 20. Therefore, it is possible to suppress occurrence of clogging of the nozzle 20 when the electrospinning apparatus 1 is re-operated.

Next, a cleaning device 202*a* according to other embodiment will be illustrated.

Figure 3A:
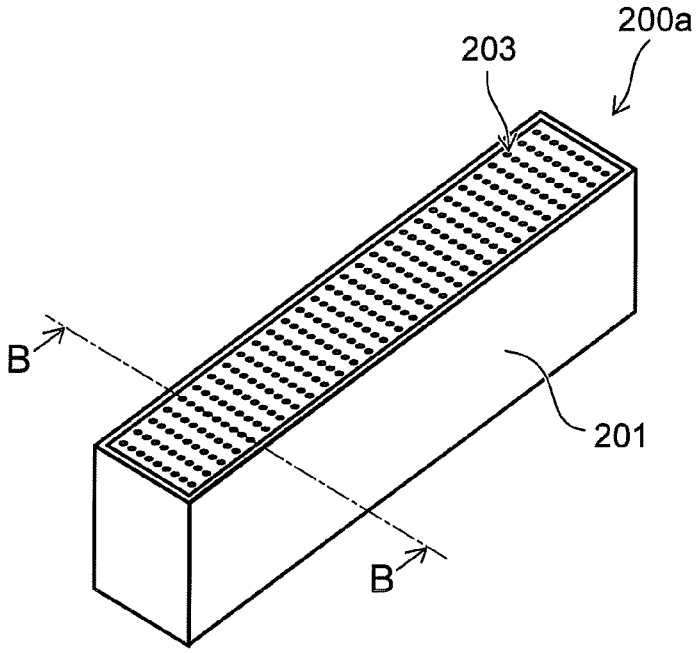
FIGS. 3A and 3B are schematic perspective views illustrating a cleaning device according to other embodiment.
Figure 3B:
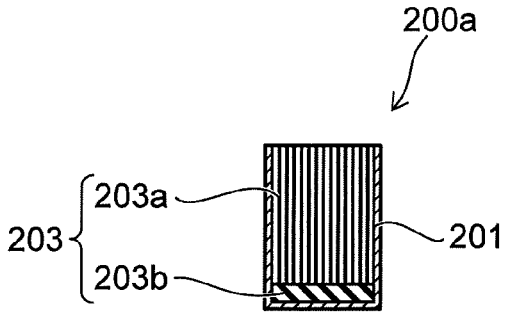

As shown in FIG. 3A, 3B, the cleaning device 202*a* is provided with the storage part 201 and a cleaning part 203.

The storage part 201 has function of holding the cleaning part 203, function of protecting the cleaning part 203, function of holding the solution, and function of suppressing evaporation of the solution. The storage part 201 can be the same as that described above.

The cleaning part 203 is provided inside the storage part 201. The cleaning part 203 includes multiple fibers 203*a* and a base 203*b*.

One end of the multiple fibers 203*a* is held on the base 203*b*. It is also possible to provide other end of the multiple fibers 203*a* at the position of the opening of the storage part 201, is also possible to provide at the slightly outer position from the position of the opening of the storage part 201, and is also possible to provide at the slightly inner position from the position of the opening of the storage part 201. Therefore, a depth dimension of the inside of the storage part 201 can be determined appropriately depending on a length of the fibers 203*a* described later.

It is favorable that a distance (gap) between the multiple fibers 203*a* is shorter than the outer dimension of the nozzle 20. In such a way, the multiple fibers 203*a* can be made contact with the nozzle 20 surely.

The solution is supplied inside the storage part 201. The solution can be the same as that described above. The supplied solution is held between the multiple fibers 203*a*. The holding force of the solution is influenced by the distance between the multiple fibers 203*a*, the surface tension of the solution, and the viscosity of the solution or the like. Therefore, the distance between the multiple fibers 203*a* can be appropriately determined by performing a simulation and an experiment or the like with consideration of the outer dimension of the nozzle 20, the surface tension of the solution, and the viscosity of the solution or the like.

If an outer dimension of the fibers 203*a* in a direction orthogonal to an extending direction of the fibers 203*a* (hereinafter, simply referred to as an outer dimension of the fibers 203*a*) is too long, or a length of the fibers 203*a* is too short, flexibility of the fibers 203*a* is too low and thus the nozzle 20 may be damaged. On the other hand, if the outer dimension of the fibers 203*a* is too short, or the length of the fiber s 203*a* is too long, the flexibility of the fibers 203*a* is too high and thus a cleaning effect may be lowered.

According to the knowledge obtained by the inventor, it is favorable that the outer dimension of the fibers 203*a* is not less than 0.075 mm and not more than 0.2 mm. It is favorable that the length of the fibers 203*a* is not less than 20 mm.

A material of the cleaning part 203 is not particularly limited as long as the material has resistance to the solution and does not give damage such as a scratch to the nozzle 20. The material of the cleaning part 203 can be, for example, a resin such as nylon and polyimide.

The base 203*b* is plate-shaped, and is held inside the storage part 201. The base 203*b* can be provided on a bottom surface of the storage part 201. The base 203*b* can be also held by using the bonding material such as the adhesive, and by using a fastening member such as a screw. The material of the base 203*b* is not particularly limited as long as the material has resistance to the solution. The material of the base 203*b* can be, for example, of a metal such as stainless steel.

The cleaning of the nozzle 20 by the cleaning device 200*a* can be the same as the cleaning of the nozzle 20 by the cleaning device 200 described above. In this case, the fibers 203*a* contact the droplet of the source material liquid and the polymer substance adhered to the tip of the nozzle 20, and the droplet of the source material liquid and the polymer substance is scraped off by the fibers 203*a*. At this time, since the droplet of the source material liquid and the polymer substance are dissolved by the solution, removal of the droplet of the source material liquid and the polymer substance becomes easy.

In the case where the removal of the droplet of the source material liquid and the polymer substance is insufficient, the relative position between the cleaning device 200*a* and the nozzle 20 should be subjected to reciprocating movement repeatedly. For example, the cleaning device 200*a* should be subjected to reciprocating movement repeatedly in an arrangement direction of the multiple nozzles 20. A relative movement speed of the cleaning device 200*a* can be, for example, approximately 10 cm/second.

In the case where time for re-operating the electrospinning apparatus 1 is long after completion of the cleaning of the nozzle 20, the tip of the nozzle 20 after the cleaning can be inserted inside the cleaning part 202. In this case, the cleaning device 200*a* can be held on the component of the electrospinning apparatus 1 by a magnet or a screw or the like. In such a way, similar to the cleaning device 200 described above, it is possible to suppress occurrence of clogging of the nozzle 20 when the electrospinning apparatus 1 is re-operated.

The cleaning device 200*a* according to the embodiment can be used for the cleaning of the blade type nozzle head as well. The life of the cleaning device 200*a* can be lengthened.

Next, a cleaning device 200*b* and an electrospinning apparatus 1*a* according to other embodiment will be illustrated.

Figure 4:
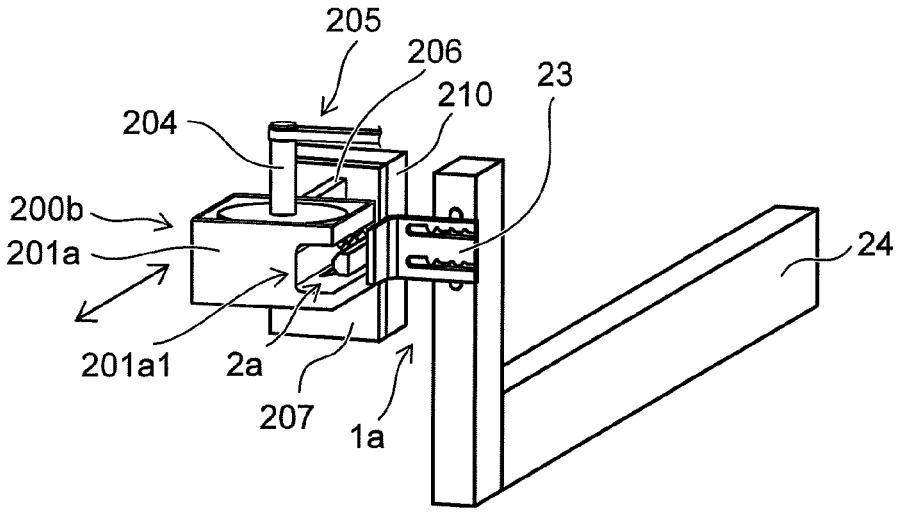
FIG. 4 is a schematic perspective view illustrating the cleaning device and the electrospinning apparatus according to other embodiment.

As shown in FIG. 4, the electrospinning apparatus 1*a* is provided with a nozzle head 2*a*, a bracket 23, and a main body part 24. Although not shown, the source material supply part 3, the power supply 4, the collection part 5, and the controller 6 are provided.

Figure 5:
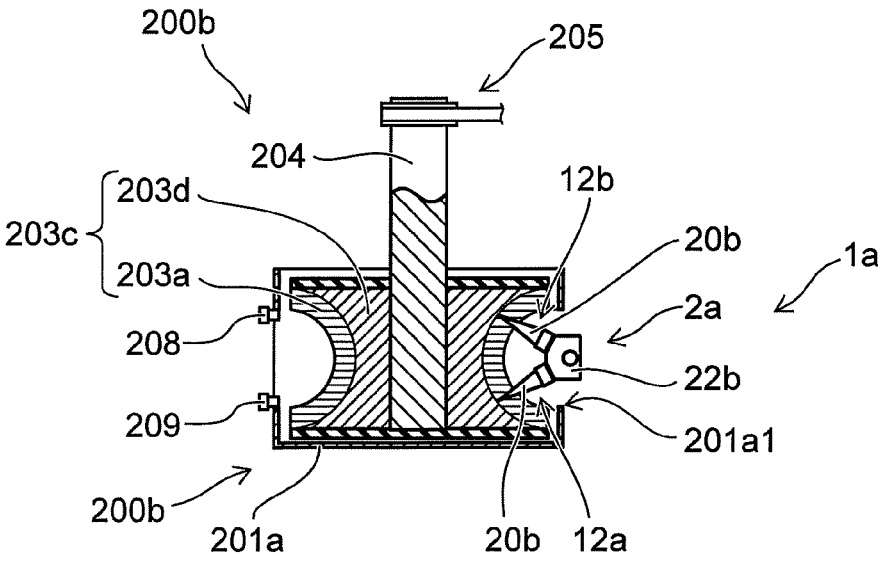
FIG. 5 is a schematic cross-sectional view of the cleaning device.

As shown in FIG. 4 and FIG. 5, the nozzle head 2*a* includes a nozzle 20*b* and a main body part 22*b*.

The multiple nozzles 20*b* are provided. The multiple nozzles 20*b* are divided into multiple groups to be provided. In this case, at least one nozzle 20*b* is provided in one nozzle group. In the following, the case where the multiple nozzles 20*b* are provided in one nozzle group is described as one example.

In one nozzle group, the multiple nozzles 20*b* are arranged in a prescribed direction to be provided. The multiple nozzles 20*b* belonging to a first nozzle group 12*a* are parallel one another. The multiple nozzles 20*b* belonging to a second nozzle group 12*b* are parallel one another.

Seen in an extending direction of the main body part 22*b*, an extending direction of the multiple nozzles 20*b* belonging to the second nozzle group 12*b* crosses an extending direction of the multiple nozzles 20*b* belonging to the first nozzle group 12*a*.

Seen in the extending direction of the main body part 22*b*, the multiple nozzles 20*b* belonging to the second nozzle group 12*b* extend in a direction away from the multiple nozzles 20*b* belonging to the first nozzle group 12*a* with approaching the tip side (discharge port side).

In such a way, seen in the extending direction of the main body part 22*b*, a distance between an end surface on the discharge port side of the multiple nozzles 20*b* belonging to the first nozzle group 12*a* and an end surface on the discharge port side of the multiple nozzles 20*b* belonging to the second nozzle group 12*b* can be more lengthened than the case where the multiple nozzles 20*b* belonging to the first nozzle group 12*a* is parallel to the multiple nozzles 20*b* belonging to the second nozzle group 12*b*. Therefore, an electric field interference between the end surface on the discharge port side of the multiple nozzles 20*b* belonging to the first nozzle group 12*a* and the end surface of the multiple nozzles 20*b* belonging to the second nozzle group 12*b* can be suppressed from occurring. As a result, formation of the fiber 100 can be stabilized.

The multiple nozzles 20 are conical and are directly provided on the main body part 22*b*. If the nozzles 20*b* are conical, mechanical strength of the nozzles 20*b* can be increased. Therefore, the nozzles 20*b* can be suppressed from being damaged during the cleaning or the like. The cleaning of the nozzles 20*b* becomes easy. Since a tip of the conical nozzles 20*b* can be sharpened, strength of the electric field formed between the nozzles 20*b* and the collection part 5 can be increased as well as the acicular nozzle 20.

The main body part 22*b* is stick-shaped. A space storing the source material liquid is provided inside the main body part 22*b*. The configuration and the material or the like of the main body part 22*b* can be the same as that of the main body part 22 described above.

The nozzle head 2*a* is attached to the main body part 24 via the bracket 23.

Figure 6:
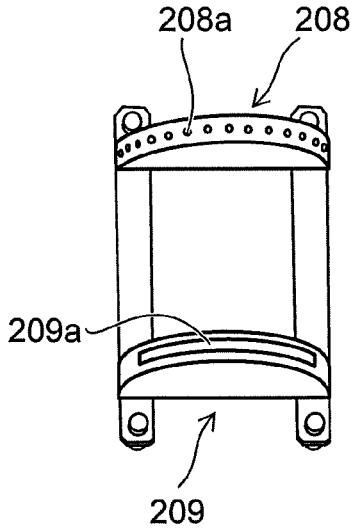
FIG. 6 is a schematic perspective view illustrating a supply part and an exhaust part.

As shown in FIG. 4, FIG. 5, and FIG. 6, the cleaning device 200*b* is provided with a storage part 201*a*, a cleaning part 203*c*, a rotation axis 204, a power transmission part 205, a supply part 208, a recovery part 209, and a movable part 210.

The storage part 201*a* is box-shaped, and an upper surface is opened. A hole 201*a*1 into which the nozzle head 2*a* is inserted is provided on a side surface of the storage part 201*a*. The storage part 201*a* has function of protecting the cleaning part 203*c*, function of suppressing scattering of the solution, and function of suppressing evaporation of the solution. A material of the storage part 201*a* can be the same as the material of the storage part 201.

The cleaning part 203*c* is provided inside the storage part 201*a*. The cleaning part 203*c* includes the multiple fibers 203*a* and a base 203*d*.

One end portion of the multiple fibers 203*a* is held on the base 203*d*. The outer dimension, the length, the material or the like of the fibers 203*a* can be the same as that described above.

The base 203*d* is drum-shaped. A material of the base 203*d* can be the same as the material of the base 203*b* described above. The base 203*d* is connected to a motor not shown via the rotation axis 204 and the power transmission part 205. The power transmission part 205 illustrated in FIG. 4 and FIG. 5 is formed of a belt and a pulley.

In the embodiment, the rotation axis 204, the power transmission part 205, the motor not shown or the like forms a rotation part rotating the cleaning part 203*c*.

As shown in FIG. 4, the storage part 201*a* is provided on a support part 207 via a bracket 206. The movable part 210 is connected to the support part 207, and the cleaning device 200*b* is configured to be movable in a direction in which the multiple nozzles 20*b* are arranged. The movable part 210 may be connected to the main body part 24 and the nozzle head 2*a* may be moved. That is, the movable part 210 changes a relative position of the nozzle 20*b* to the cleaning part 203*c*. The movable part 210 can be, for example, that including a servo motor and a ball screw.

As shown in FIG. 5, the supply part 208 and the recovery part 209 are provided on a side surface of the storage part 201*a* on a side opposite to a side where the hole 201*a*1 is provided.

The supply part 208 can be provided on an upper surface side of the storage part 201*a*. The supply part 208 is connected to a solution supply device not shown. The solution supply device can includes, for example, a tank storing the solution, a pump sending the solution, a regulator valve regulating a discharge amount of the solution, and a switch valve switching start of the discharge of the solution and stop of the discharge. The supply part 208 is provided with multiple discharge ports 208*a*. The solution supplied inside the supply part 208 is discharged toward the cleaning part 203*c* (multiple fibers 203*a*) from the multiple discharge ports 208*a*.

The recovery part 209 can be provided on a bottom surface side of the storage part 201*a*. The recovery part 209 recoveries the used solution. The recovery part 209 is connected to a not shown solution recovery device. The solution recovery device can include, for example, a blower suctioning the solution and air, a switch valve switching start of the suction and stop of the suction, a separator separating the solution and air, and a tank storing the separated solution or the like. The recovery part 209 is provided with a slit 209*a*. The used solution is suctioned from the slit 209*a* with air and discharged outside the storage part 201*a*.

In this case, the controller described above can control movement of the cleaning device 200*b* or the nozzle head 2*a* by the movable part 210, rotation of the base 203*d* by a not shown motor, discharge of the solution from the supply part 208 by a not shown pump, recovery of the used solution via the recovery part 209 by a not shown blower or the like.

Next, the operation of the cleaning device 200*b* will be described.

First, the base 203*d* provided with the multiple fibers 203*a* is rotated by the not shown motor via the rotation axis 204 and the power transmission part 205. A rotation speed can be, for example, appropriately 40 rpm to 50 rpm.

Next, the solution is discharged from the multiple discharge ports 208*a* toward the cleaning part 203*c* (multiple fibers 203*a*). The used solution is suctioned with air from the slit 209*a*.

Next, the cleaning device 200*b* is moved by the movable part 210 in a direction in which the multiple nozzles 20*b* are arranged, and the multiple nozzles 20*b* are inserted into the multiple fibers 203*a*. A relative movement speed of the cleaning device 200*b* can be, for example, approximately 10 cm/second.

Then, the droplet of the source material liquid and the polymer substance adhered to the tip of the nozzle 20 are scraped off by the rotating multiple fibers 203*a*. The droplet of the source material liquid and the polymer substance are dissolved easily by the solution. Therefore, the removal of the droplet of the source material liquid and the polymer substance becomes easy.

A rotation direction of the base 203*d* can be changed. If the rotation direction of the base 203*d* is changed, it becomes easy to contact the fibers 203*a* to the whole side surface of the nozzle 20, and thus cleaning performance can be improved.

The used solution is discharged outside the storage part 201*a* via the slit 209*a* of the recovery part 209 with the removed droplet of the source material liquid and the polymer substance, and air.

Next, the cleaning device 200*b* is moved in an opposite direction by the movable part 210, and the multiple nozzles 20*b* are spaced from the multiple fibers 203*a*. The relative movement speed of the cleaning device 200*b* can be, for example, approximately 10 cm/second.

Completion of the cleaning of the nozzle 20*b* can be, for example, visually checked by an operator as well, and can be checked by using an image processing device as well.

After the cleaning of the nozzle 20*b* is completed, the electrospinning apparatus 1 is re-operated.

In the above, although an extending direction of the rotation axis 204 and the direction in which the multiple nozzles 20*b* are arranged cross, the extending direction of the rotation axis 204 and the direction in which the multiple nozzles 20*b* are arranged may be parallel.

Although the case where the multiple fibers 203*a* are provided is illustrated, the cleaning part 202 based on the polymer substance may be provided. In this case, the notch 202*a* and the groove or the like can be provided at positions corresponding to the multiple nozzles 20*b*. A taper (entrance) can be provided on opening portions of the notch 202*a* and the groove or the like.

Next, a cleaning device 200*c* and the electrospinning apparatus 1*a* according to other embodiment will be illustrated.

Figure 7:
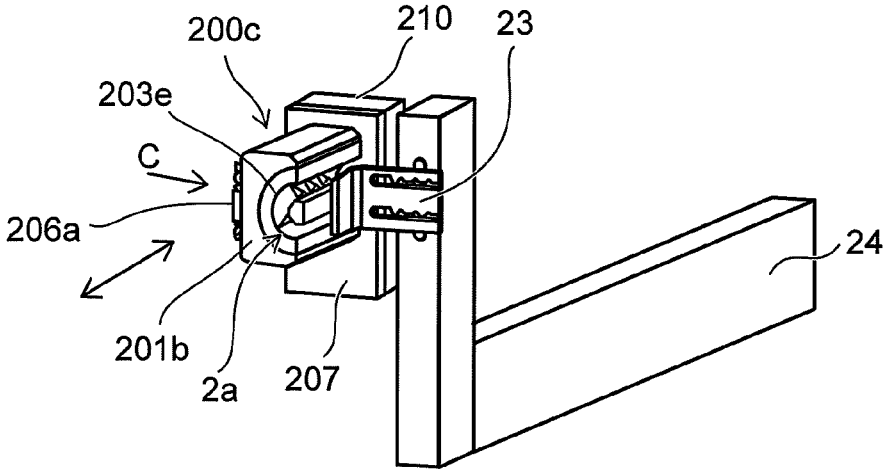
FIG. 7 is a schematic perspective view illustrating a cleaning device and an electrospinning apparatus according to other embodiment.
Figure 8:
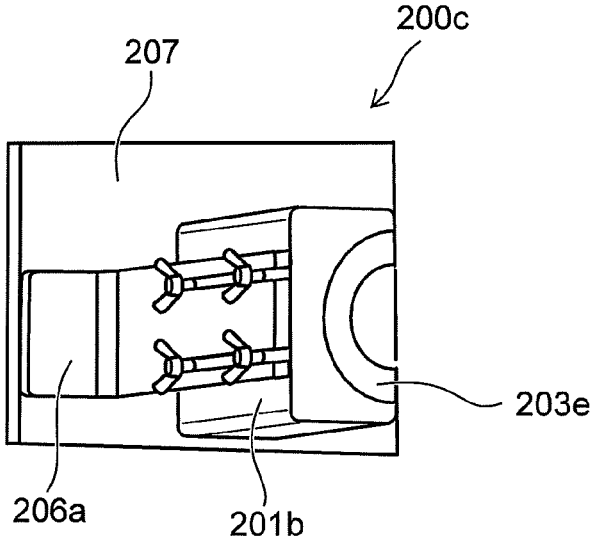
FIG. 8 is a schematic perspective view in a case where the cleaning device in FIG. 7 is seen from a C-direction.

As shown in FIG. 7 and FIG. 8, the cleaning device 200*c* is provided with a storage part 201*b*, a cleaning part 203*e*, a bracket 206*a*, the support part 207, and the movable part 210.

The storage part 201*b* is block-shaped. The cleaning part 203*e* is provided on one side surface of the storage part 201*b*. A material of the storage part 201*b* is not particularly limited as long as the material has a certain degree of rigidity. The storage part 201*b* can be formed by using, for example, a metal such as stainless steel, and a resin such as nylon and polyimide.

The cleaning part 203*e* may be based on the polymer amorphous body, and based on multiple fibers.

The solution is supplied to the cleaning part 203*e* by an operator or a not shown supply device.

The storage part 201*b* is provided on the support part 207 via the bracket 206*a*. The support part 207 is connected to the movable part 210, and the cleaning device 200*c* is configured to be movable in the direction in which the multiple nozzles 20*b* are arranged. The movable part 210 may be connected to the main body part 24 and the nozzle head 2*a* may be moved.

The storage part 201*b* is attached to the bracket 206*a* by using a fastening member such as a thumb screw. Therefore, the cleaning device 200*c* is easily detachable.

Next, the operation of the cleaning device 200*c* will be described.

First, the solution is supplied to the cleaning part 203*e* by an operator or a not shown supply device.

Next, the cleaning device 200*c* is moved by the movable part 210 in the direction in which the multiple nozzles 20*b* are arranged, and the multiple nozzles 20*b* are inserted into the fibers or the polymer amorphous body. A relative movement speed of the cleaning device 200*c* can be, for example, approximately 10 cm/second.

Then, the droplet of the source material liquid and the polymer substance adhered to the tip of the nozzle 20*b* are scraped off by the multiple fibers or the polymer amorphous body. The droplet of the source material liquid and the polymer substance are dissolved by the solution. Therefore, the removal of the droplet of the source material liquid and the polymer substance becomes easy. The cleaning device 200*c* can be subjected to a reciprocating motion repeatedly.

Next, the cleaning device 200*c* is moved by the movable part 210 in the opposite direction, and the multiple nozzles 20*b* are spaced from the multiple fibers or the polymer amorphous body. The relative movement speed of the cleaning device 200*c* can be, for example, approximately 10 cm/second.

Completion of the cleaning of the nozzle 20*b* can be, for example, visually checked by an operator as well, and can be checked by using an image processing device as well.

After the cleaning of the nozzle 20*b* is completed, the electrospinning apparatus 1 is re-operated.

Next, a cleaning device 200*d* according to other embodiment will be illustrated.

Figure 9:
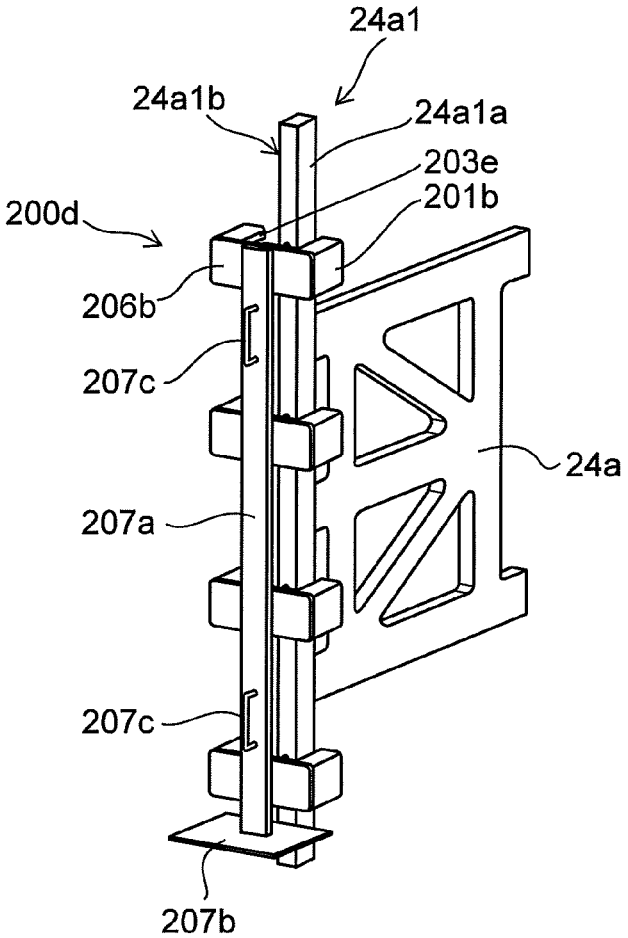
FIG. 9 is a schematic perspective view illustrating a cleaning device and an electrospinning apparatus according to other embodiment.
Figure 10:
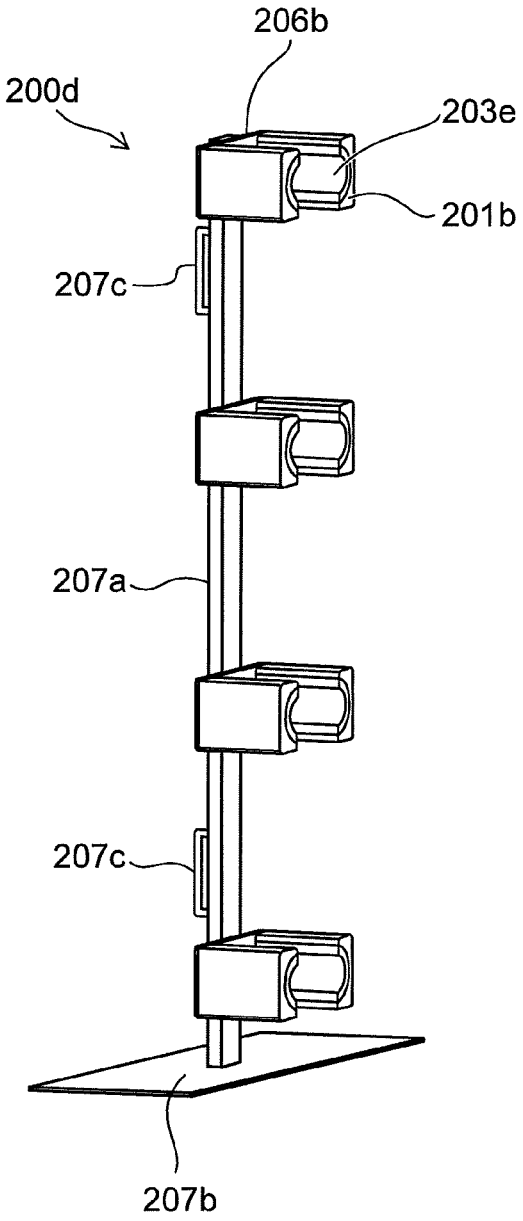
FIG. 10 is a schematic perspective view of the cleaning device.

The cleaning device 200*d* is illustrated in FIG. 9 and FIG. 10.

In FIG. 9, the multiple nozzle heads 2*a* or the like are omitted.

In FIG. 9, not shown multiple nozzle heads 2*a* are attached to a mounting part 24*a*1 of the main body part 24*a*. The mounting part 24*a*1 is plate-shaped. The multiple nozzle heads 2*a* are provided to be arranged on one surface 24*a*1*a* of the mounting part 24*a*1. The multiple nozzle heads 2*a* are provided to be arranged also on a surface 24*a*1*b* of the mounting part 24*a*1 opposing to the surface 24*a*1*a*.

As shown in FIG. 9 and FIG. 10, the cleaning device 200*d* is provided with the storage part 201*b*, the cleaning part 203*e*, a bracket 206*b*, a support part 207*a*, a leg 207*b*, and a handle 207*c*.

One pair of storage part 201*b* and cleaning part 203*e* are provided for one nozzle head 2*a*. The multiple storage parts 201*b* are provided at positions corresponding to the multiple nozzle heads 2*a*.

The multiple storages part 201*b* are provided on the support part 207*a* via the bracket 206*b*. The support part 207*a* is plate-shaped, and the leg 207*b* is provided one end portion. The grab 207*c* is provided on a side of the support part 207*a* opposite to a side where the multiple storage parts 201*b* are provided.

The solution is supplied to the cleaning part 203*e* by an operator or a not shown supply device.

Next, the operation of the cleaning device 200*d* will be described.

First, the solution is supplied to the cleaning part 203*c* by an operator or a not shown supply device.

Next, the operator grabs the handle 207*c* and has the cleaning device 200*d*, moves the cleaning device 200*d* in the direction in which the multiple nozzles 20*b* are arranged, and inserts the multiple nozzles 20*b* into the multiple fibers or the polymer amorphous body. A relative movement speed of the cleaning device 200*d* can be, for example, approximately 10 cm/second.

Then, the droplet of the source material and the polymer substance adhered to the tip of the nozzle 20*b* are scraped off by the multiple fibers of the polymer amorphous body. The droplet of the source material and the polymer substance are dissolved by the solution. Therefore, the removal of the droplet of the source material and the polymer substance becomes easy. The cleaning device 200*c* can be subjected to a reciprocating motion repeatedly.

Next, the operator moves the cleaning device 200*d* in the opposite direction, and the multiple nozzles 20*b* are spaced from the multiple fibers or the polymer amorphous body. The relative movement speed of the cleaning device 200*d* can be, for example, approximately 10 cm/second.

Completion of the cleaning of the nozzle 20*b* can be, for example, visually checked by an operator as well, and can be checked by using an image processing device as well.

After the cleaning of the nozzle 20*b* is completed, the electrospinning apparatus 1*a* is re-operated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention. Moreover, above-mentioned embodiments can be combined mutually and can be carried out.

What is claimed is:

1. A cleaning device for cleaning a plurality of nozzles arranged in a line in an arrangement direction on a nozzle head of an electrospinning apparatus, the device comprising:

a cleaner configured to rotate around an axis and to remove at least one of a droplet of a source material liquid and a polymer substance adhered to the plurality of the nozzles, the cleaner being flexible;

an adjuster configured to adjust a relative position between the cleaner and the plurality of nozzles in the arrangement direction; and a slit configured to suction at least one of the droplet of the source material liquid and the polymer substance removed from the plurality of nozzles by the cleaner.

2. The device according to claim 1, where the cleaner includes a polymer amorphous body.

3. The device according to claim 1, where the cleaner includes a base, and a plurality of fibers having one end portion held on the base.

4. The device according to claim 1, further comprising a supply part provided on a storage part, the supply part supplying a solution to the cleaner.

5. An electrospinning apparatus, comprising:

a nozzle head comprising a plurality of nozzles arranged in a line in an arrangement direction;

a source material supply configured to supply a source material liquid to the nozzle head;

a power supply configured to apply a voltage having a prescribed polarity to the nozzle head;

a cleaner configured to rotate around an axis and to remove at least one of a droplet of the source material liquid and a polymer substance adhered to the plurality of the nozzles, the cleaner being flexible;

an adjuster configured to adjust a relative position between the cleaner and the nozzle head in the arrangement direction; and a slit configured to suction at least one of the droplet of the source material liquid and the polymer substance removed from the plurality of nozzles by the cleaner.

* * * * *